US006866208B2

(12) United States Patent
Kao

(10) Patent No.: US 6,866,208 B2
(45) Date of Patent: Mar. 15, 2005

(54) GARDENING SPRAYING NOZZLE

(76) Inventor: Wen Li Kao, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/437,612

(22) Filed: May 15, 2003

(65) Prior Publication Data

US 2004/0227017 A1 Nov. 18, 2004

(30) Foreign Application Priority Data

May 14, 2002 (CN) ..... 91207015 U

(51) Int. Cl.[7] ..... B05B 7/02

(52) U.S. Cl. ..... 239/526; 239/525; 239/390; 239/391; 239/393; 239/395; 239/397

(58) Field of Search ..... 239/525, 526, 239/390, 391, 392, 393, 394, 395, 396, 397

(56) References Cited

U.S. PATENT DOCUMENTS 5,772,121 A * 6/1998 Wang ..... 239/394
6,164,566 A * 12/2000 Hui-Chen ..... 239/394
6,230,988 B1 * 5/2001 Chao ..... 239/394
6,286,767 B1 * 9/2001 Hui-Chen ..... 239/394
6,460,782 B1 * 10/2002 Wang ..... 239/390

* cited by examiner

*Primary Examiner*—Binh Q. Tran

(57) ABSTRACT

A gardening spraying nozzle comprises an outer annular cover installed at a water outlet of a spraying nozzle, a water outlet cover integrally formed with the outer annular cover, a water control disk within the water outlet cover, and an water outlet valve coupling to the water outlet of the spraying nozzle. The outer annular cover is integrally formed to the water outlet cover. The water outlet cover includes a mist-like spraying seal section and a low pressure water seal section; an annular end surface of the water control disk is formed with a sealing section corresponding to the low pressure water seal section of the water outlet cover. Thereby, the water outlet cover is buckled by the water control disk and the water control disk is buckled by the water outlet valve. Thereby, when the outer annular cover is rotated. It moves with the other element.

1 Claim, 5 Drawing Sheets

GARDENING SPRAYING NOZZLE

BACKGROUND OF THE INVENTION

The present invention relates to nozzles, and particularly to a gardening spraying nozzle which presents various spraying effects.

A prior art spraying nozzle is shown in FIG. 1. It is mainly formed by a water outlet cover 5 locking to the water outlet A1 of a spraying nozzle A, and a water control disk 6 locking to the water outlet cover 5. The water outlet cover 5 is locked with the annular edge of the water nozzle A by an O ring 7.

However, in above mentioned prior art, the O ring 7 has the function of tight engagement, but water can drain out from between the spraying nozzle A and the nozzle head. When the spraying nozzle A and the nozzle head are engaged through the O ring 7, the nozzle head can not rotate due to the confinement of the O ring 7 and moreover, the water flow pattern is confined. To improvement above said defect, the spraying nozzle A can not be tightly engaged to the nozzle head, but this will induce that the water flowing to the nozzle head will drain out from the place between the water outlet cover 5 and the spraying nozzle A so as to wet the palm and cuff of the user.

SUMMARY OF THE INVENTION

Accordingly, the primary object of the present invention is to provide a gardening spraying nozzle comprises an outer annular cover installed at a water outlet of a spraying nozzle, a water outlet cover integrally formed with the outer annular cover, a water control disk within the water outlet cover, and an water outlet valve coupling to the water outlet of the spraying nozzle. The outer annular cover is integrally formed to the water outlet cover. Water outlet cover includes a mist-like spraying seal section and a low pressure water seal section. An annular end surface of the water control disk is formed with a sealing section corresponding to the low pressure water seal section of the water outlet cover. Thereby, the water outlet cover is buckled by the water control disk and the water control disk is buckled the water outlet valve. Thereby, when the outer annular cover is rotated. It moves with the other element.

The various objects and advantages of the present invention will be more readily understood from the following detailed description when read in conjunction with the appended drawing.

BRIEF DESCRIPTION OF THE PREFERRED EMBODIMENTS

Figure 1:
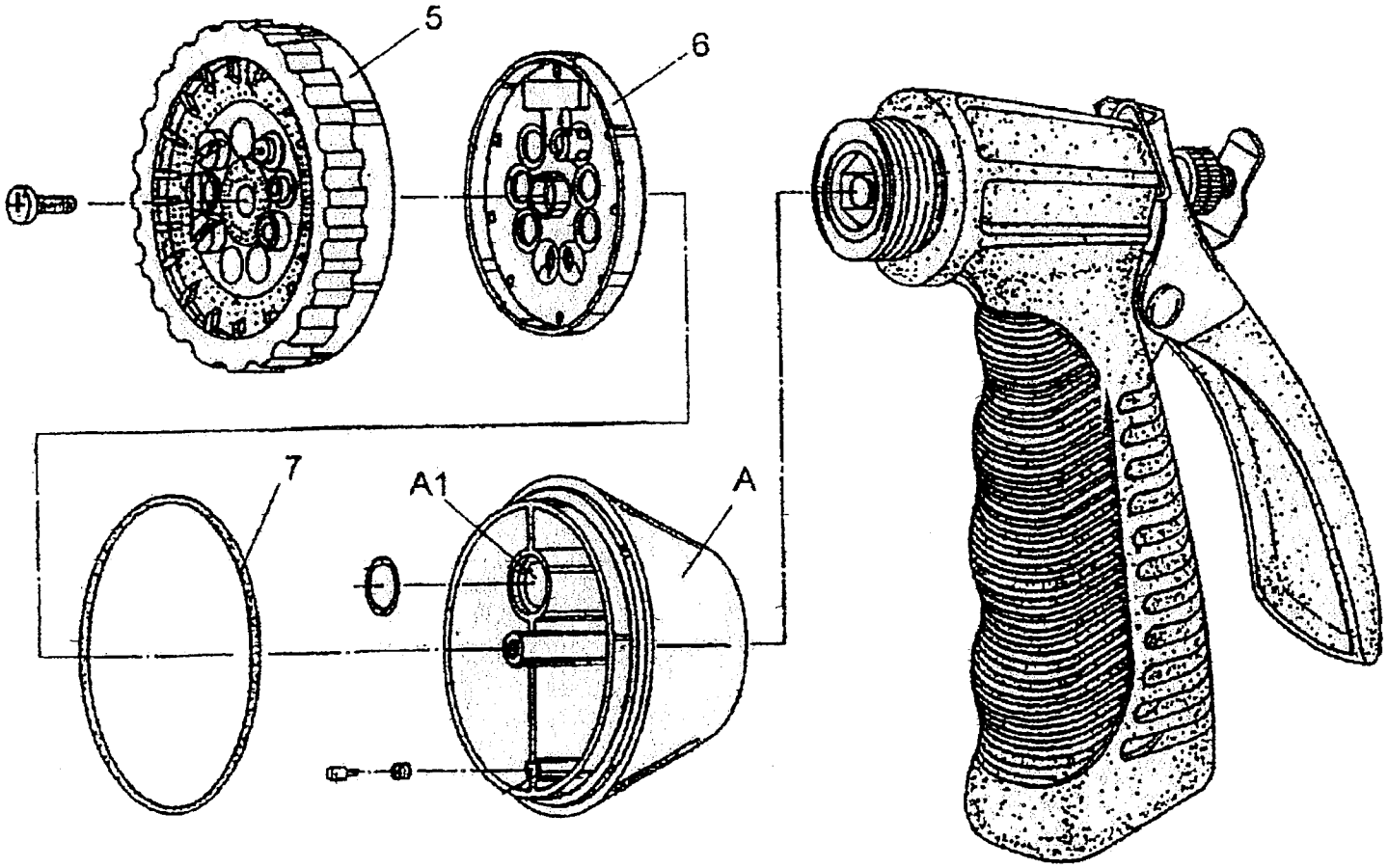
FIG. 1 is an exploded perspective view of the prior art spraying nozzle.
Figure 2:
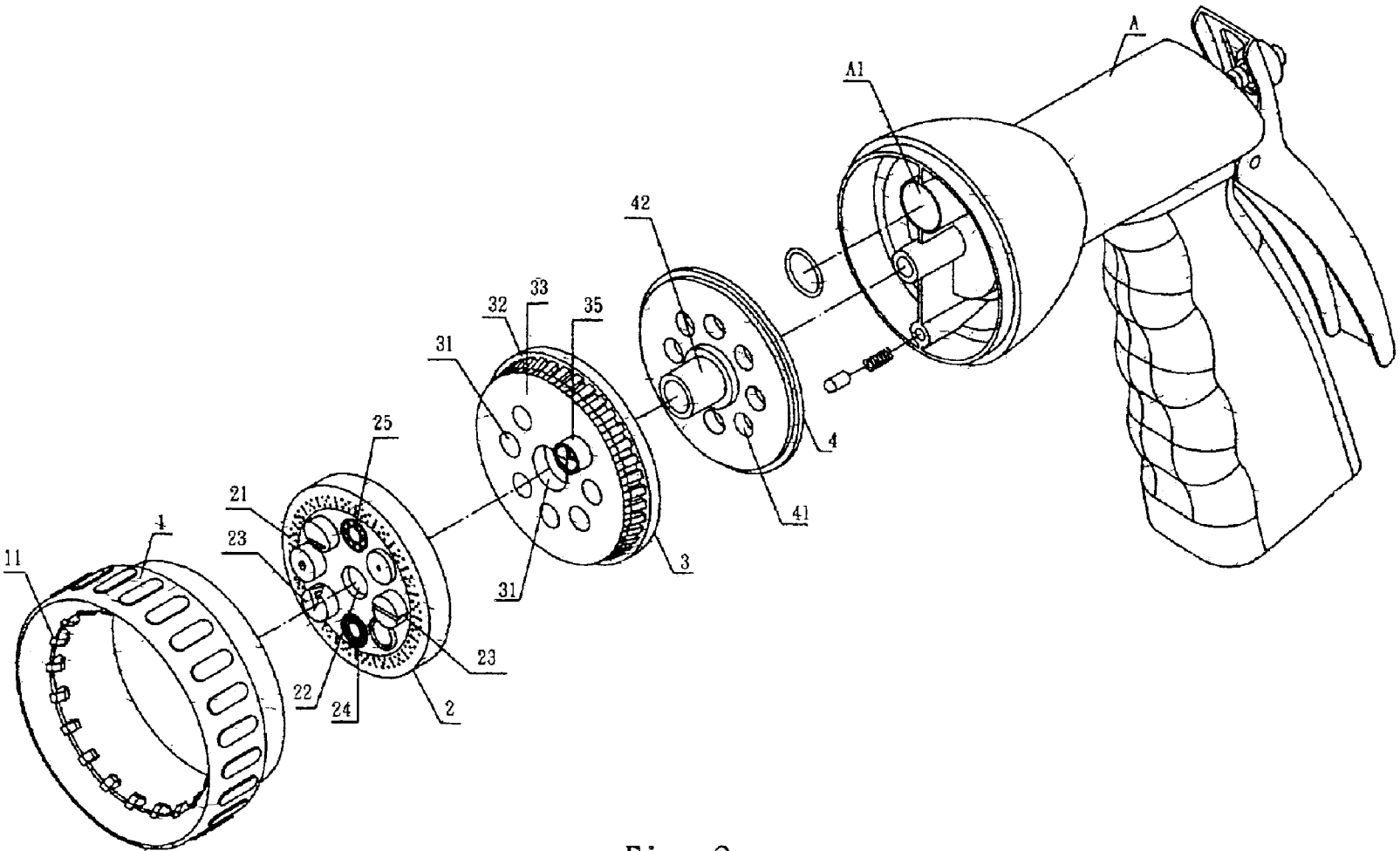
FIG. 2 is an exploded perspective view of the spraying nozzle of the present invention.
Figure 3:
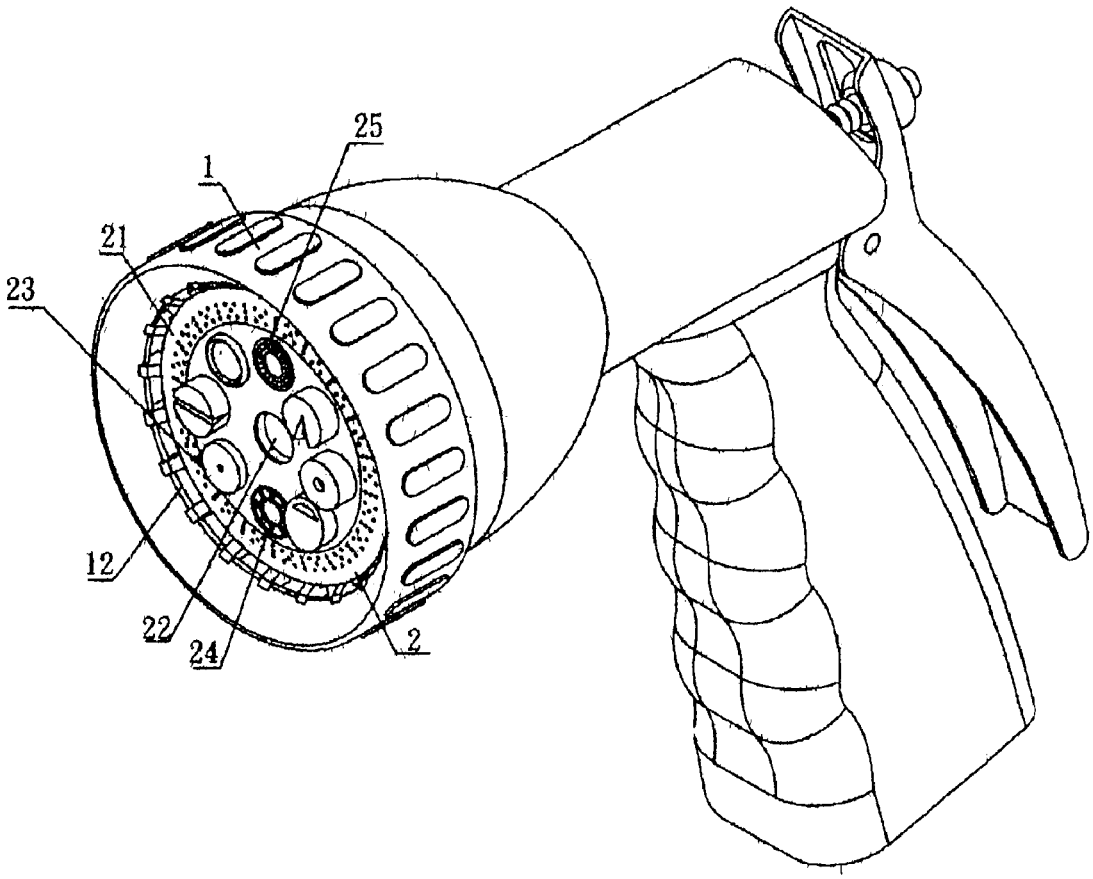
FIG. 3 is an assembled perspective view of the spraying nozzle of the present invention.

Referring to FIGS. 2 and 3, the structure of the present invention is illustrated. The gardening spraying nozzle of the present invention is formed by an outer annular cover 1 installed at a water outlet A1 of a spraying nozzle A, a water outlet cover 2 integrally formed with the outer annular cover 1, a water control disk 3 within the water outlet cover 2, and an water outlet valve 4 coupling to the water outlet A1 of the spraying nozzle.

The outer annular cover 1 and the water outlet cover 2 are formed as an integral body; a plurality of ribs 11 spaced irregular are formed between an inner annular edge of the outer annular cover 1 and the water outlet cover 2. A round lower pressure water outlet 12 is formed between the outer annular cover 1 and the water outlet cover 2.

An outer edge of the Water outlet cover 2 has a plurality of net holes 21 which are arranged around the edge for spraying mist-like spraying water. A center of the water outlet cover 2 has a positioning hole 22. A plurality of water spraying holes 23 are arranged on the water outlet cover 2 and around the positioning hole 22. The water spraying holes 23 have various configurations. The water spraying holes 23 include a mist-like spraying seal section 24 and a low pressure water seal section 25.

An end surface of the water control disk 3 has a plurality of via holes 31 corresponding to the water spraying holes 23 and positioning holes 22 of the water outlet cover 2. A central via hole 31 of the water control disk 3 is capable of being engaged to the water outlet valve 4. A periphery of the Water control disk 3 is installed a whole cycle of low pressure water outlet 32. An annular end surface of the water control disk 3 is formed with a sealing section 33 corresponding to the low pressure water seal section 25 of the water outlet cover 2. A flow stopper 34 is installed at an inner surface of the sealing section 33. Thereby, when water in the spraying nozzle A flows into the water control disk 3, the water can be stopped on the inner surface of the water control disk 3. The end surface of the water control disk 3 is formed with a plurality of buckling rings 35 for buckling the water outlet cover 2.

An end surface of the water outlet valve 4 has a plurality of water inlets 41 corresponding to the via holes 31 of the water control disk 3. Thereby, water flows through the water inlets 41 to the water spraying holes 23 of the water outlet cover 2 through the via holes 31. A center of the water outlet valve 4 is exactly protruded with a confining ring 42 which protrudes to the centers of the water control disk 3 and the water outlet cover 2 for confining the water control disk 3 and water outlet cover 2. The water outlet valve 4 has a plurality of confining ring for resisting against the water control disk 3.

The outer annular cover 1 is integrally formed with a water outlet cover 2. The water outlet cover 2 is buckled to the water control disk 3 and the Water control disk 3 is buckled to the water outlet valve 4. An annular edge of water control disk 3 is welded to the outer annular cover 1 by high frequency. Thereby, when the Outer annular cover 1 is rotated, it can move with the water outlet cover 2, water control disk 3, and outer annular cover 1.

Figure 4:
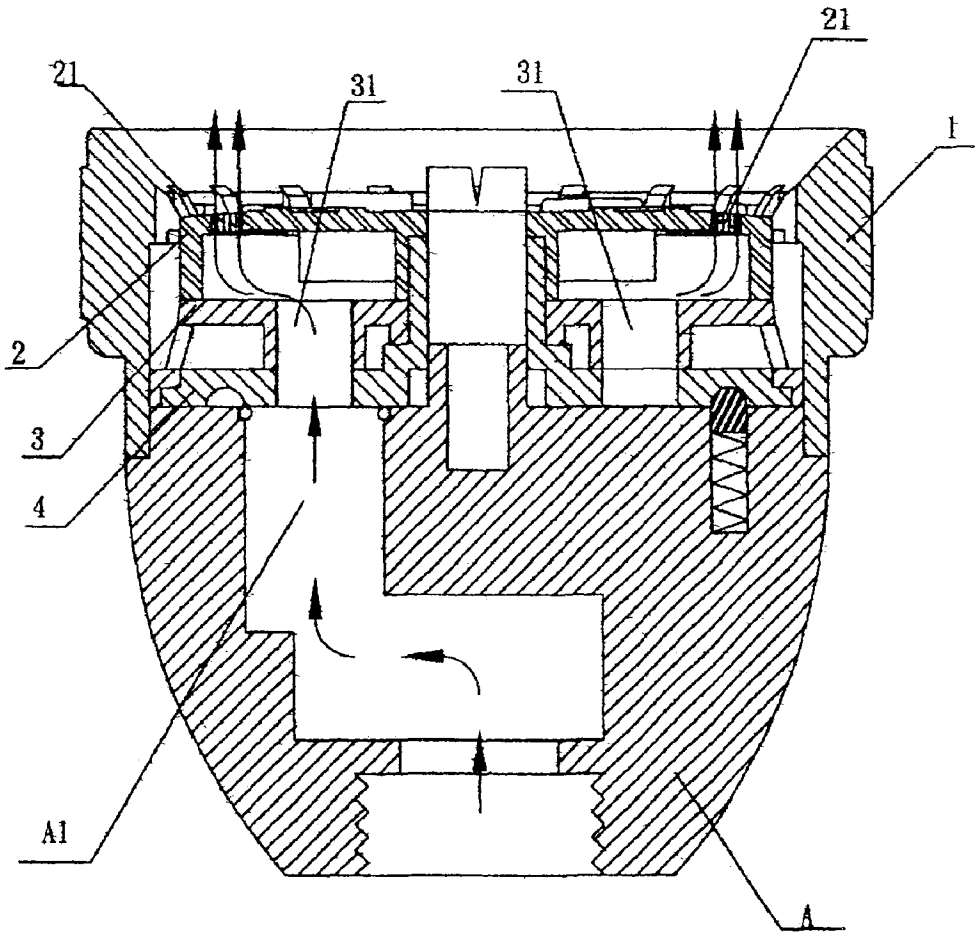
FIG. 4 shows the embodiment of the low pressure water of the present invention.
Figure 5:
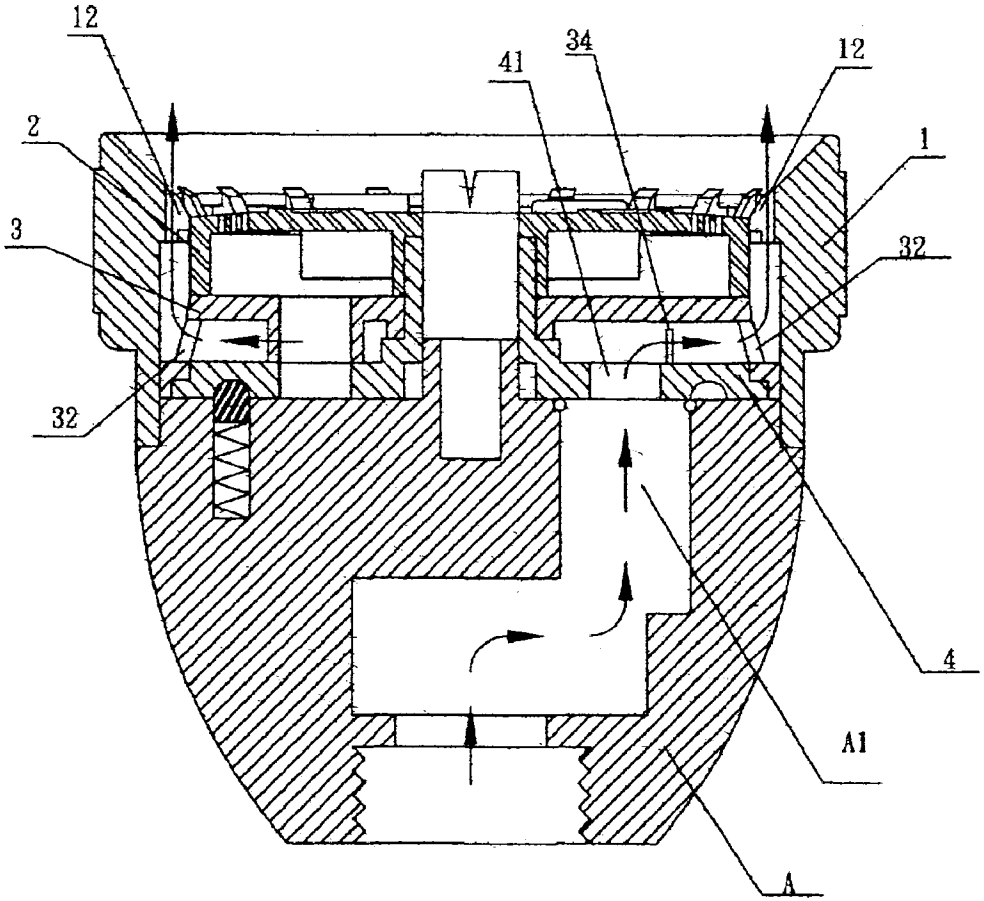
FIG. 5 shows the embodiment of the mist-like water flow of the present invention.

The assembly of the present invention will be described with FIGS. 4 and 5, by the synchronous rotation of outer annular cover 1 with the water outlet cover 2, water control disk 3 and water outlet valve 4, when the outer annular cover 1 rotates to a position that the low pressure water seal section 25 is coupled to the water outlet A1 of the spraying nozzle A, since the portion of the water control disk 3 corresponding to the low pressure water seal section 25 of the water outlet cover 2 is the sealing section 33, water flows into the water control disk 3 from the water outlet valve 4. The water can be stopped at an inner surface of the water control disk 3 by the flow stopper 34 so that the water flows into the annular edge of the water control disk 3. Then the water is sprayed out through the low pressure water outlet 32 and then through the lower pressure water outlet 12 so as to form with a low pressure spray from the periphery of the outer annular cover 1 (referring to FIG. 4). When the outer annular cover 1 rotates to the mist-like spraying seal section 24 to align with the water outlet A1 of the spraying nozzle A, since the water flows into the water outlet cover 2 from the water outlet valve 4 can not flow out from the mist-like spraying seal section 24 and thus is confined to an interior of the water outlet cover 2. The water is sprayed out from the net holes 21 at an outer edge of the end surface of the water outlet cover 2 so as to form a mist-like water spray (referring to FIG. 5).

When rotating the outer annular cover 1 of the nozzle head, the outer annular cover 1 rotates with the water outlet cover 2, water control disk 3, and outer annular cover 1, and the outer annular cover 1 is integrally formed with the water control disk 3, when Water flows out from the spraying nozzle A. No water drains out from between the nozzle head and the spraying nozzle. Thus the hand and cuff will not wet by water.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A gardening spraying nozzle comprising an outer annular cover installed at a water outlet of a spraying nozzle, a water outlet cover integrally formed with the outer annular cover, a water control disk within the water outlet cover, and an water outlet valve coupling to the water outlet of the spraying nozzle;

a lower pressure water outlet being formed between the outer annular cover and the water outlet cover; an outer edge of the water outlet cover has a plurality of net holes which are arranged around the edge for spring mist-like spraying water; a center of the water outlet cover having a positioning hole; a plurality of water spraying holes being arranged on the water outlet cover and around the positioning hole; the water spraying holes having various configurations; an end surface of the water control disk having a plurality of via holes corresponding to the water spraying holes and positioning holes of the water outlet cover; a central via hole of the water control disk capable of being engaged to the water outlet valve; an end surface of the water outlet valve having a plurality of water inlets corresponding to the via holes of the water control disk; characterized in that:

the outer annular cover being integrally formed with the water outlet cover; the water outlet cover being formed with a mist-like spraying seal section and a low pressure water seal section among the water spraying holes; an annular end surface of the water control disk is formed with a sealing section corresponding to the low pressure water seal section of the water outlet cover;

thereby, the water outlet cover is buckled to the water control disk and the water control disk is buckled to the water outlet valve; an annular edge of water control disk is welded to the outer annular cover; and thus, when the outer annular cover is rotated, it moves with the water outlet cover, water control disk, and outer annular cover; and wherein a flow stopper is installed at an inner surface of the sealing section; thereby, when water in the spraying nozzle flows into the water control disk, the water is stopped on the inner surface of the water control disk; the end surface of the water control disk is formed with a plurality of buckling rings for buckling the water outlet cover.

* * * * *